US005685013A

United States Patent [19]

Hausman

[11] Patent Number: 5,685,013

[45] Date of Patent: Nov. 11, 1997

[54] HAND, WRIST, AND FOREARM PROTECTIVE DEVICE

[76] Inventor: Michael R. Hausman, 168 E. 95th St., New York, N.Y. 10128

[21] Appl. No.: 652,329

[22] Filed: May 22, 1996

[51] Int. Cl.[6] ..... A41D 13/08

[52] U.S. Cl. ..... 2/16; 2/161.1; 2/162

[58] Field of Search ..... 2/16, 20, 160, 2/161.1, 161.6, 162; 602/21, 5, 16; 473/62, 59, 61, 63

[56] References Cited

U.S. PATENT DOCUMENTS

| | | | |
|---|---|---|---|
| 4,011,596 | 3/1977 | Chang | 2/16 |
| 4,101,704 | 7/1978 | Hiles | 428/218 |
| 4,478,408 | 10/1984 | Brückner | 272/76 |
| 4,556,992 | 12/1985 | Drury | 2/20 |
| 4,660,832 | 4/1987 | Shomo | 273/73 |
| 4,782,825 | 11/1988 | Lonardo | 302/21 |
| 4,850,341 | 7/1989 | Fabry et al. | 128/44 |
| 4,942,624 | 7/1990 | Cho | 2/16 |
| 5,150,475 | 9/1992 | Hansen et al. | 2/16 |
| 5,168,576 | 12/1992 | Krent et al. | 2/2 |
| 5,254,078 | 10/1993 | Carter et al. | 302/21 |
| 5,274,846 | 1/1994 | Kolsky | 2/2 |
| 5,313,667 | 5/1994 | Levine | 2/16 |
| 5,339,465 | 8/1994 | Kyewski | 2/20 |
| 5,376,066 | 12/1994 | Phillips et al. | 602/21 |
| 5,423,087 | 6/1995 | Krent et al. | 2/2 |
| 5,459,878 | 10/1995 | Gold | 2/161.1 |
| 5,526,531 | 6/1996 | Olson et al. | 602/21 |
| 5,566,389 | 10/1996 | Li | 2/16 |

*Primary Examiner*—C. D. Crowder
*Assistant Examiner*—Larry D. Worrell, Jr.
*Attorney, Agent, or Firm*—Sofer & Haroun, LLP

[57] ABSTRACT

A protective device for mitigating the risks and hazards of fractures and injuries to the wrist and forearm that is intended to be utilized by individuals who participate in skating activities or other sports played on hard surfaces. The device has semi-rigid splint members which are fastened above and below the wearer's forearm and extend from the palm area of the hand longitudinally along the forearm toward the elbow. The palm area of the device includes an arched portion of the splint member which defines a space for containing a shock absorber which cushions the impact of a fall, thereby alleviating the extent of injury to the wrist and forearm areas. The palm area also includes a spring for transmitting the force of a fall along the extremity of the forearm splint members and the palmar portion of the protective device. In a preferred embodiment of the invention, splint members which lie along the palmar of the forearm slide relative to each other for additional impact and injury mitigation.

16 Claims, 2 Drawing Sheets

HAND, WRIST, AND FOREARM PROTECTIVE DEVICE

FIELD OF THE INVENTION

This invention relates to protective devices, and in particular, to a device for protecting the hand, wrist and forearm area and for substantially preventing injuries resulting from the impact of falls while participating in skating activities, snowboarding, and other sports.

BACKGROUND OF THE INVENTION

The surge in popularity of roller sports, such as in-line skating and roller hockey, in addition to ice skating, snowboarding, and skateboarding has led to an increasing number of injuries associated with these activities. One prevalent injury resulting from falls while participating in these activities is injury to the bones and ligaments in the hand, wrist, and forearm such as the ulna, radius, carpal bones or the interosseus ligaments and triangular fibrocartilage complex. These bone fractures and ligament injuries are a result of the natural reflex of the person participating in the activity to break a fall by extending his arms and falling upon the wrist or hands. Since in-line skating, snowboarding, skateboarding and other skating activities are generally performed on hard surfaces, such as asphalt streets, ice surfaces, and playground blacktops, the force, stress, and energy of the skater's fall may often be substantial and thus frequently result in serious injury to the aforementioned bones and ligaments.

The use of splints and protective splint devices may confer some protection to the user against injuries to the bones and ligaments of the hand, wrist, and forearm. A variety of splint-like devices have been developed for protecting the hand, wrist, and/or forearm areas. These prior art devices, however, do not provide adequate protection to avoid serious bone and ligament injuries.

The protective devices of the prior art have failed to prevent the large number of bone and ligament injuries to the hand, wrist and forearm areas because these devices generally extend over too limited a region of the limb or over too much of the limb region, thereby protecting too little of the susceptible area or being too confining, restrictive and uncomfortable for the user to wear. Furthermore, these known devices lack shock absorption and energy dissipation properties which decrease the kinetic energy of impact below the threshold required for fracture or ligament disruption, so as to prevent injury to the bones and ligaments in the hand, wrist and forearm. These discomforts and deficiencies inherent in the prior art devices prevent their widespread or extensive use.

For instance, in U.S. Pat. No. 4,011,596 to Chang, a device is disclosed which includes a splint secured to the wearer's arm by a sleeve of fabric which extends along the entire forearm. This device also includes a layer of impact-absorbent material which extends co-extensively along the entire length of the forearm with the sleeve secured to the wearer. The Chang device, however, does not provide adequate shock absorption and energy dissipation to alleviate serious injury to the wearer. Likewise, in U.S. Pat. No. 4,556,992 to Drury, a protective device is disclosed in the shape of a hand pad worn over the hand, but extending only to the wrist area. This device contains protective padding on the back portion of the hand, but offers no protection to the forearm, wrist, and palmar side of the hand.

U.S. Pat. No. 5,150,475 to Hansen et al. provides a protective wristband which is wrapped around the entire circumference of the wrist area and has a cushioned shield disposed between the inner and outer layers of fabric which comprises the wristband. The Hansen device, however, affords only some protection to the wrist area and no protection to the forearm and palmar side of the hand.

U.S. Pat. No. 5,339,465 to Kyewski provides a palm guard in arched configuration which is comprised of a plastic material and is utilized by insertion into a glove worn by the user. This device, while offering localized protection to the palm of the wearer's hand, offers little protection to the wearer's wrist and no protection to the wearer's forearm.

Accordingly, there is a need for a protective device that provides sufficient shock absorption and energy dissipation properties so as to decrease the kinetic energy that causes fracture or ligament disruption as a result of a human fall from standing length. It is desired that such protective device decrease and/or alleviate injuries to the bones and ligaments of the wrist, hand and forearm which may result from participation in skating, snowboarding, skateboarding and various other athletic activities.

OBJECTS AND SUMMARY OF THE INVENTION

It is a general object of the present invention to provide a lightweight, inexpensive, protective hand, wrist, and forearm protective device having a shock absorber means and a spring means located in the palmar area of the device for protecting the wearer from injury as a result of the impact of a fall while skating or participating in other sports.

It is a further object of this invention to provide a hand, wrist, and forearm protective device which includes semi-rigid splint members which lie along the top side, also referred to as dorsal region or dorsal portion, and underside, also referred to as palmar region or palmar portion of a wearer's forearm. The splint member located on the palmar region of the wearer's forearm provides support for both a shock absorber and a spring, both of which are positioned on the exterior surface of the palm area of the device.

It is a further object of this invention to provide a hand, wrist, and forearm protective device which includes a semi-rigid palmar splint member having a shock absorber and a spring attached to the exterior surface of the palm area of the splint member which lies and extends along the palmar region of the wearer's forearm.

It is a further object of this invention to provide an impact absorbing space between the palmar splint member and the spring member, within which a shock absorber is disposed.

It is a further object of the present invention to utilize, in combination, a shock absorber and a spring means so that force caused by the impact of a fall is both absorbed and dissipated rather than one or the other.

It is an additional object to provide a hand, wrist and forearm protective device in which the outer spring and the shock absorber disposed within the impact absorbing space are effective in absorbing the energy from the impact of a fall and mitigating such impact by diffusing the force of the impact over a sufficient area of the extremity of the hand, wrist, and forearm of the wearer so that the force per unit area is reduced to a level below the threshold for serious bony or ligamentous injury.

It is an additional object of the present invention to provide a hand, wrist and forearm protective device in which the splint members may be manufactured in a variety of lengths to suit the size and age of the user, or to suit the type of activity for which the protective device is to be used so as to maximize the efficacy and comfort.

It is an additional object of the present invention to protect the soft tissues of the hand, wrist and forearm from abrasion.

In accordance with one aspect of the present invention, the following are provided: (1) a hand, wrist, and forearm protective device having dorsal and palmar splint members, (2) a spring member which extends along the palmar region of the forearm adjacent the palmar splint member, (3) a shock absorber localized within a defined space between the lower spring and the palmar splint member, and (4) fastening means for securing the splint members in their proper place along the hand, wrist and forearm of the wearer to provide optimal protection to these anatomical areas.

In accordance with another aspect of the invention, a protective device comprises a dorsal splint member which extends along the dorsal portion of the forearm of the wearer to a portion proximate the metacarpophalangeal joint of the hand, a palmar splint member having a distal palm portion and an elongated forearm portion which extends along the lower palmar portion of the forearm of the wearer to a portion overlaying the palm of the wearer, and a spring member attached to the palmar splint member. The portions of the dorsal and palmar splint members which lay upon the respective portions of the wearer's forearm are concave to optimize the contact and fit between the device and the wearer's forearm and hand.

In accordance with another aspect of the invention, impact absorbing space is provided between the distal palm portion of the palmar splint member and the spring member. Like the palmar splint member, the spring member advantageously also has an elongated forearm portion which extends coaxially along the palmar region of the wearer's forearm with the palmar splint member. The proximal portion of the spring member extends along the palmar splint member, and is securely attached to the palmar splint member along an area within the proximal portion of the palmar splint member. Fastening means secure the dorsal splint member to the dorsal region of the forearm and secure the palmar splint member and the spring member to the palmar region of the forearm of the wearer.

In accordance with still another aspect of this invention the palmar portion of the palmar splint member is configured as an arch protruding outward from the palmar region of the hand to bias the palm upwardly in order to extend the wearer's hand in flexion at a predetermined angle in relation to the longitudinal axis of the wearer's forearm. Furthermore, the distal portion of the dorsal splint member is also configured upwardly to provide support for the dorsal region of the wearer's hand.

In the event of a fall with the user's hand and arm extended, the spring member contacts the ground. This transmits the force to the shock absorber and also to the palmar surface of the palmar splint member which, in turn, transmits the force along the palmar surface of the forearm in a uniform fashion so that one particular zone is not excessively loaded. The dorsal splint member also provides additional support to further diffuse the energy of the fall.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

Figure 1:
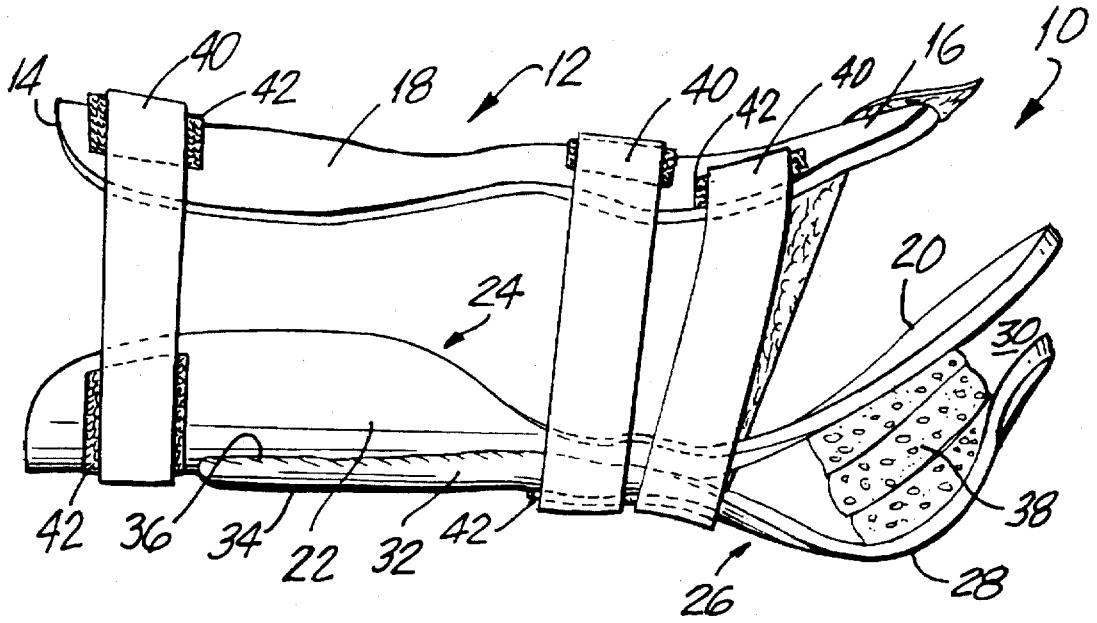
Figure 2:
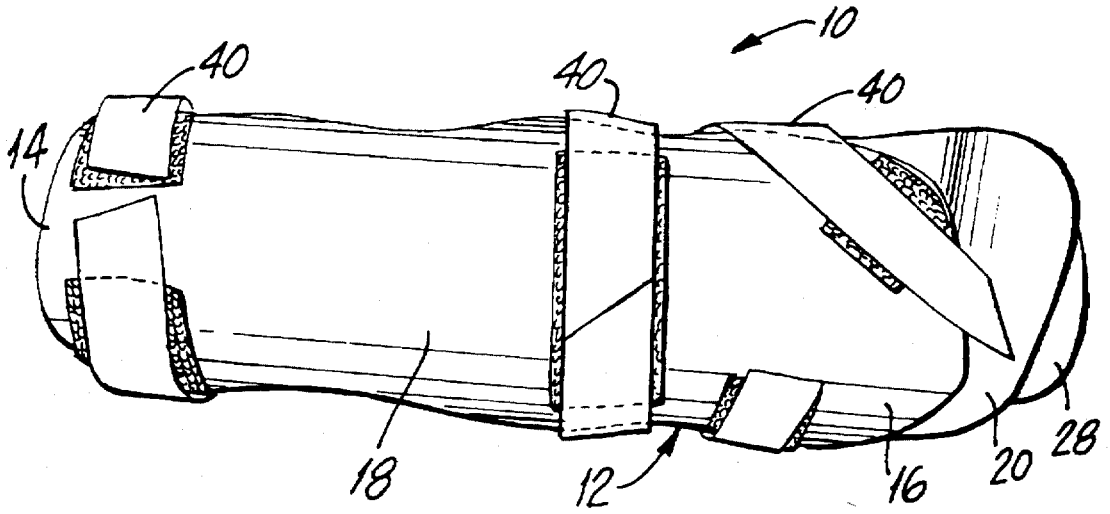
Figure 3:
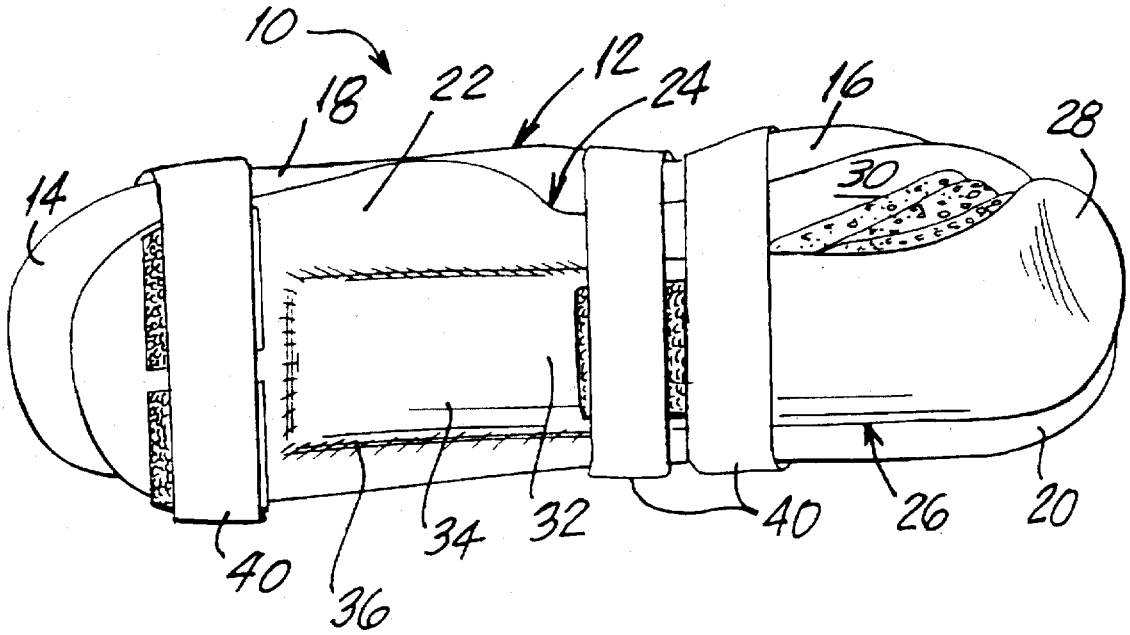

In the drawings in which like reference characters denote similar elements throughout the several views:

FIG. 1 illustrates a side elevational view of one embodiment of a hand, wrist, and forearm protective device constructed in accordance with the subject invention;

FIG. 2 illustrates a plan view of the hand, wrist, and forearm protective device embodiment illustrated in FIG. 1, viewed from above the device in the position it would take if placed on the dorsal region of the wearer's forearm; and FIG. 3 illustrates a bottom view of the hand, wrist, and forearm protective device embodiment illustrated in FIG. 1, viewed from below the device in the position it would take if placed on the palmar region of the wearer's forearm.

Figure 4:
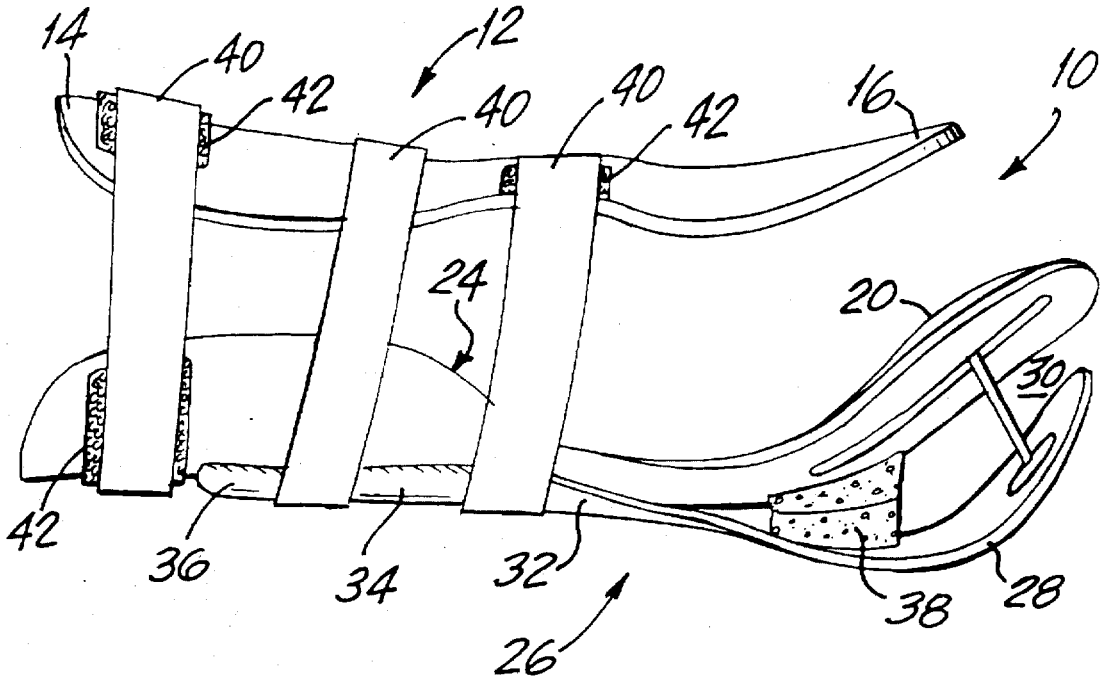

FIG. 4 illustrates a side elevational view of an alternative embodiment of the hand, wrist, and forearm protective device in accordance with the subject invention.

DETAILED DESCRIPTION OF THE PRESENTLY PREFERRED EMBODIMENT

Referring now to FIG. 1, a hand, wrist, and forearm protective device embodying the principles of the present invention is shown generally as reference numeral 10, although the invention is not limited to the embodiment illustrated in FIG. 1. The hand, wrist, and forearm protective device 10 constructed in accordance with the present invention, is preferably comprised of dorsal and palmar splint members 12 and 24, and a spring member 26, the two splint members being secured to and laying along the respective upper (dorsal) and lower (palmar) portion of a wearer's hand, wrist, and forearm (not shown).

As shown in FIG. 1, dorsal splint member 12 has a proximal portion 14 and an elongated forearm portion 18 which lie along the forearm of a wearer and extend distally and longitudinally along the dorsal portion of the forearm of the wearer towards the hand to a position 16 proximate the metacarpophalangeal joint of the wearer (not shown). Palmar splint member 24 has a distal palm portion 20 overlaying the palm of the wearer and an elongated forearm portion 22 positioned along the palmar region of the forearm of the wearer, extending longitudinally from the palm along the forearm towards the elbow region. Dorsal and palmar splint members 12, 24 are configured to form concave surfaces, such that when placed against the wearer's forearm they provide an optimized contact and fit between the device and the wearer's forearm and hand.

A spring member 26 is provided having preferably an arched distal palm portion 28, an elongated forearm portion 32, and a proximal portion 34. Spring member 26 and palmar splint member 24 preferably lie in coaxial relation and extend together along the dorsal portion of the forearm of the wearer. Spring member 26 is preferably a leaf spring, however, any other spring known in the art will perform equally well. Proximal portion 34 of spring member 26 may be securely attached in an attachment area 36 to palmar splint member 24 by any of numerous methods known in the art, such as welding, gluing, stapling, screwing and riveting, although the invention is not limited in that respect. Furthermore, proximal portion 34 may be secured in another area which is substantially closer to distal palm portion 28 than that illustrated as attachment area 36 in FIG. 1.

Arched distal palm portion 28 of spring member 26 preferably extends away from its coaxial plane with palmar splint member 24 to define an impact absorbing space 30. Within the impact absorbing space a shock absorber 38 is disposed, which may be comprised of any known substance having shock and impact absorbent properties as well as resilient properties. Shock absorber 38 is preferably composed of microcellular urethane. The invention is not, however, limited to a shock absorber 38 made of microcellular urethane. For instance, other materials such as foam rubber, neoprene rubber, laminated foam, polyurethane foam and the like may be substituted for microcellular.

Within impact absorbing space 30, shock absorber 38 may be one piece of the suitable shock absorbing material, or may comprise laminate layers of the shock absorbing material depending on the requirement for the size of the impact absorbing space 30 and the thickness of the shock absorber 38. The density of the shock absorbing material utilized may be varied to permit adjustment depending upon the size and weight of the user and the particular sport the wearer is participating in. Upon impact with a hard surface resulting from a wearer's fall, the distal portion of palmar splint member 24 and spring member 26 compress shock absorber 38 positioned therebetween in the impact absorbing space 30. Additionally, the distal portion of palmar splint member 24 and spring member 26 may be advantageously spaced apart to permit the distal portion of palmar splint member 24 and spring member 26 to slide relative to each other upon impact. In the alternative, the palmar splint member 24 and spring member 26 may be connected via a 60 pin and slotted hole 62 as illustrated in FIG. 4, allowing palmar splint member 24 and spring member 26 to slide co-axially relative to each other upon impact.

This sliding of the distal portion of palmar splint member 24 and spring member 26, as well as the spring effect resultant from the arched configuration of distal palm portion 28 of spring member 26, advantageously mitigate the impact stemming from a fall by absorbing the energy resulting from the impact of the fall and diffusing the force of the impact by transmitting it uniformly over a sufficient area of the extremity of the palmar splint member 24 along the forearm and palmar side of the hand, although the scope of the invention is not limited in that respect. Additionally, upon impact, the sliding commences a frictionable interaction between the distal portion of palmar splint member 24 and spring member 26 which provides added protection to the wearer as a result of even greater dispersal of the thrust of the impact along the splint members.

In accordance with one aspect of this invention, distal palm portion 20 of palmar splint member 24 is configured with arched distal palm portion 28 protruding outward from the palm region of the hand for the purpose of biasing the palm upwardly to extend the wearer's hand in flexion at a predetermined angle in relation to the longitudinal axis 44 (shown in FIG. 1) of the wearer's forearm. The distal portion of dorsal splint member 12 is also configured upwardly at an angle substantially equal to the predetermined angle of the palmar splint member 24 and preferably in the range of 20 to 25 degrees, although the invention is not limited in scope to this position. This dorsiflexion of the distal portions of dorsal splint member 12 and palmar splint member 24 places and supports the hand and wrist in a physiologically desirable "neutral" position which serves to alleviate the thrust of impact of a fall and optimally transmits the impact uniformly across the extremity of the forearm, wrist, and hand of the wearer. The upward configuration of the distal portion of dorsal splint member 12 also provides support for the distal region of the wearer's hand.

As shown in FIGS. 1, 2, and 3, fastening means 40 are utilized for releasably securing dorsal splint member 12 to the upper side of the wearer's forearm, and for securing palmar splint member 24 and spring member 26 to the underside of the wearer's forearm. Dorsal and palmar splint members 12, 24, and spring member 26 are provided with one or more patches of loop-type fastener strips 42 fixed to various corresponding locations on both of the splint members 12 and 24, and the spring member 26. Hook-type fastener strips 40 extend around the wearer's forearm for releasably engaging the loop-type fastener strips 42 to securely fasten the hand, wrist, and forearm protective device 10 in its proper position, and to permit precise adjustment of tension. Hook-type fastener strips 40 and loop-type fastener strips 42 may be similar to the material marketed under the trademark Velcro®. Other known fastening means may also be used such as strings, snaps, a releasable adhesive tape or a double-back buckle. In an alternative embodiment of the present invention, "D"-type rings (not shown) are positioned on dorsal and palmar splint members 12, 24 to permit the hook-type fastener strips 40 to be passed through, folded over the "D"-type ring, and engaged with the loop-type fastener strips so as to permit even greater strength and precision of adjustment.

Dorsal splint member 12 and palmar splint member 24 are preferably formed from molded polyethylene plastic, resin-impregnated carbon or graphite material, or metal. Other rigid or semi-rigid, materials such as plastic, fiberglass reinforced epoxy, polyester resins, polycarbonate, acetyl, acrylonitrile-butadiene-styrene and other similar materials may also be used. Spring member 26 is preferably formed of a carbon fiber composite, a thermoplastic resin-impregnated fiber or metallic material, although the invention is not limited in scope to the material used to fabricate spring member 26.

Optionally, the protective device of the present invention may be provided with a liner (not shown) along the inside surfaces of dorsal splint member 12 and palmar splint member 24. The liner may be a cloth material or a layer of polyester or polyolefin padding incorporating a hydrophilic, vapor permeable membrane. Such a liner would add to the wearer's comfort by absorbing perspiration from the wearer's hand, wrist, and forearm, in addition to aiding in the prevention of skin abrasions which may be sustained when the wearer falls and the impact causes dorsal splint member 12 and palmar splint member 24 to rub against the skin. The liner may be removable for cleaning or replacement.

In an alternative embodiment of the present invention, palmar splint member 24 may be made of a molded, semi-rigid material to preferably include a palm support splint portion and an outer impact spring portion in a unitary arrangement. The outer impact spring portion may include an arched distal portion similar to arched distal palm portion 28 as shown in FIG. 1. The arched distal portion of the outer impact spring portion may define an impact absorbing space such as 30 between the palm support splint portion and the outer impact spring portion. Within the impact absorbing space 30, the shock absorber may be secured, similar to shock absorber 38 as shown in FIG. 1. The shock absorber 38 of the alternative embodiment may be any of the aforementioned shock and impact absorbent materials. The palm support splint portion facilitates the positioning of the wearer's palm when the hand, wrist, and forearm protective device is properly worn.

It should be evident to those skilled in the art that although the hand, wrist, and forearm protective device of the present invention is especially suited for individuals who participate in skating, snowboarding, and skateboarding, the protective device of the present invention may also be successfully utilized for alleviating wrist injuries in other activities and sports where wrist injuries are prevalent such as ice skating, football and soccer.

Thus, while fundamental novel features of the preferred embodiments of the invention have been shown and described, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

I claim:

1. A hand, wrist, and forearm protective device to be worn along an exterior surface of the hand, wrist and forearm for protection against impacts, comprising:

a dorsal splint member having a proximal portion and an elongated forearm portion to extend along the dorsal portion of the forearm of the wearer to a distal portion proximate to the metacarpophalangeal joint of the wearer;

a palmar splint member having an elongated forearm portion and a distal palm portion having an end, said elongated forearm portion extending along the palmar portion of the forearm of the wearer to a portion overlying the palm of the wearer; and a spring member having a proximal portion, an elongated forearm portion, and a distal palm portion having an end, the proximal portion of said spring member being further configured to securely attach to an area within the proximal portion of said palmar splint member, said spring member further defining an impact absorbing space between said distal palm portion of said palmar splint member and said distal palm portion of said spring member, the end of said distal palm portion of said spring member configured to be spaced apart and separate from the end of said distal portion of said palmar splint member.

2. The hand, wrist, and forearm protective device of claim 1 further comprising a shock absorber contained within said impact absorbing space for absorbing impacts to said hand, wrist, and forearm protective device.

3. The hand, wrist, and forearm protective device of claim 2 further comprising fastening means for securing said dorsal splint member to the dorsal portion of the forearm and securing said palmar splint member and said spring member to the palmar portion of the forearm of the wearer.

4. The hand, wrist, and forearm protective device of claim 2, wherein said distal palm portion of said palmar splint member is configured as an arch to bias the palm upwardly to extend the wearer's hand in flexion at a predetermined angle in relation to the longitudinal axis of the wearer's forearm.

5. The hand, wrist, and forearm protective device of claim 4, wherein said distal portion of said dorsal splint member is configured upwardly to provide support for the wearer's hand.

6. The hand, wrist, and forearm protective device of claim 5, wherein said distal portion of said dorsal splint member is configured upwardly at an angle substantially equal to said predetermined angle of said distal palm portion of said palmar splint member.

7. The hand, wrist, and forearm protective device of claim 5, wherein upon impact of said end of said distal palm portion of said spring member with the end of said distal portion of said palmar splint member, said end of said distal palm portion of said spring member contacts and slides along said distal palm portion of said palmar splint member.

8. The hand, wrist, and forearm protective device of claim 7, wherein said shock absorbing material is made of microcellular urethane.

9. The hand, wrist, and forearm protective device of claim 7, wherein said shock absorbing material is made of foam robber.

10. The hand, wrist, and forearm protective device of claim 4, wherein said fastening means include a plurality of loop-type fastener strips and corresponding hook-type fastener strips, said corresponding loop-type fastener strips and said corresponding hook-type fastener strips being releasably engageable for securing said hand, wrist, and forearm protective device in its proper position.

11. A hand, wrist, and forearm protective device to be worn along an exterior surface of the hand, wrist and forearm for protection against impact, comprising:

a dorsal splint member having a proximal portion and an elongated forearm portion to extend along the dorsal region of the forearm of the wearer to a distal portion proximate to the metacarpophalangeal joint of the wearer;

a palmar splint member having a distal portion and an elongated forearm portion to extend along the palmar region of the forearm of the wearer, said distal portion of said palmar splint member further comprises a palm support splint portion for positioning the wearer's palm and an outer impact spring portion having an arched distal portion defining an impact absorbing space between said palm support splint portion and said outer impact spring portion, wherein said palm support splint portion is configured as an arch to bias the palm upwardly to extend the wearer's hand in flexion at a predetermined angle in relation to the longitudinal axis of the wearer's forearm;

a shock absorber contained within said impact absorbing space for absorbing impacts to said hand, wrist, and forearm protective; and fastening means for securing said dorsal splint member to dorsal region of the forearm and for securing said palmar splint member to the palmar region of the forearm of the wearer.

12. The hand, wrist, and forearm protective device of claim 11, wherein said distal portion of said dorsal splint member is configured upwardly to provide support for the wearer's hand.

13. The hand, wrist, and forearm protective device of claim 12, wherein said distal portion of said dorsal splint member is configured upwardly at an angle substantially equal to said predetermined angle of said palm support splint portion.

14. The hand, wrist, and forearm protective of claim 11, wherein said shock absorbing material is made of microcellular urethane.

15. The hand, wrist, and forearm protective of claim 11, wherein said shock absorbing material is made of foam rubber.

16. The hand, wrist, and forearm protective of claim 11, wherein said fastening means include a plurality of loop-type fastener strips and corresponding hook-type fastener strips, said corresponding loop-type fastener strips and said corresponding hook-type fastener strips being releasably engagable for securing said hand, wrist, and forearm protective device in its proper position.

* * * * *